US005336961A

United States Patent [19]

Jacquot et al.

[11] Patent Number: 5,336,961

[45] Date of Patent: Aug. 9, 1994

[54] SOURCE OF IONS WITH ELECTRONIC CYCLOTRONIC RESONANCE

[75] Inventors: Bernard Jacquot, Novy-Chevrieres; Marc Delaunay, Grenoble, both of France

[73] Assignee: Commissariat a l'Energie Atomique, Paris, France

[21] Appl. No.: 877,544

[22] Filed: May 1, 1992

[30] Foreign Application Priority Data

May 14, 1991 [FR] France ..... 91 05803

[51] Int. Cl.[5] ..... H01J 1/50; H05H 1/02

[52] U.S. Cl. ..... 313/153; 313/361.1; 313/362.1; 315/111.81; 315/111.71; 250/423 R

[58] Field of Search ..... 313/153, 361.1, 359.1, 313/362.1, 231.31, 231.51; 315/111.41, 111.51, 111.71, 111.21, 111.81; 250/423 R; 204/298.37, 298.38

[56] References Cited

U.S. PATENT DOCUMENTS 4,780,642 10/1988 Jacquot ..... 313/359.1
4,788,473 11/1988 Mori et al. ..... 314/111.41
5,132,597 7/1992 Goebel et al. ..... 313/359.1

FOREIGN PATENT DOCUMENTS 0238397 9/1987 European Pat. Off. .
1017399 1/1989 Japan .

OTHER PUBLICATIONS

Journal of Vacuum Science & Technology 8257a 8(1990) May/Jun., No. 3, New York, US "Potential Applications of an Electron Cyclotron Resonance Multicusp Plasms Source" by: Tsai et al., pp. 2900–2903.

*Primary Examiner*—Donald J. Yusko
*Assistant Examiner*—Vip Patel
*Attorney, Agent, or Firm*—Hayes, Soloway, Hennessey, Grossman & Hage

[57] ABSTRACT

A device for optimizing a source of ions with electronic cyclotronic resonance (ECR) is provided. The present invention comprises a conventional ECR source to which an apparatus is added for moving the resonance point (C) which appears in the dielectric pipe when the source is in operation. The controlled adjustment of the position of the resonance point (C) ensures an optimal positioning of points A and B of the equimagnetic surface, points (A) and (B) being dependent on point (C). The resonance displacement apparatus comprises, in one embodiment, a magnetic screw threaded onto its periphery so as to form a screw/nut system with the armouring of the ECR source. Particular utility is found in the area of particle accelerator equipment for use in scientific and medical applications, although other utilities are contemplated.

3 Claims, 3 Drawing Sheets

SOURCE OF IONS WITH ELECTRONIC CYCLOTRONIC RESONANCE

FIELD OF THE INVENTION

The present invention concerns the improvement of a source of ions with electronic cyclotronic resonance (ECR) allowing in particular for the production of multicharged ions.

BACKGROUND OF THE INVENTION

This source can be used in many ways according to the various values of the kinetic energy of the ions produced and can be used in ionic and microetching applications and more particularly in the equipment of accelerators of particles used in scientific and medical applications.

In ion sources with electronic cyclotronic resonance, the ions are obtained via the ionization inside a closed chamber, such as a hyperfrequency cavity, of a gaseous medium constituted by one or several metallic vapors or gases with the aid of electrons highly accelerated by means of electronic cyclotronic resonance. This resonance is obtained by virtue of the combined action of a high frequency (HF) electromagnetic field injected into the chamber containing the gas to be ionized, and a magnetic field existing in this chamber whose amplitude B satisfies the following electronic cyclotronic resonance condition:

$$B=f.2\pi m/e,$$

in which e represents the charge of the electron, m its mass and f the frequency of the electromagnetic field.

In these sources, the quantity of ions able to be produced results from competition between two processes: firstly, the formation of ions via the electronic impact on neutral atoms constituting the gas to be ionized, and secondly the destruction of these same ions by recombining them singly or collectively when the latter collide with a neutral atom; this neutral atom may originate from the gas still not ionized or even be produced on the walls of the chamber via the impact of an ion on said walls.

This drawback can be avoided by confining the ions formed inside the chamber constituting the source, as well as the electrons used to ionize said ions. This is effected by creating inside the chamber radial and axial magnetic fields defining an "equimagnetic" surface having no contact with the walls of the chamber and concerning which the electronic cyclotronic resonance condition is satisfied. This surface has the shape of a rugby ball. The closer this equimagnetic surface is to the walls of the chamber, the more effective it is as it makes it possible to limit the presence volume of the neutral atoms and thus the quantity of ions/neutral atoms collisions. This surface also makes it possible to confine the ions and the electrons produced via ionization of the gas. By means of this confinement, the created electrons are able to bombard a given ion several times and to fully ionize it.

This type of source of ions has been described in the document filed on Mar. 13, 1986 in the name of the Applicant and published under the number FR-A-2 595 868.

FIG. 1 diagrammatically shows a source of ions according to the prior art. This source includes a chamber 1 constituting a resonant cavity able to be excited by a high frequency (HF) electromagnetic field. This electromagnetic field is produced by an electromagnetic wave generator 3; it is introduced inside the chamber 1 by means of a wave guide 5 and a transition cavity 20.

This source also includes a magnetic structure (7, 9, 11) externally shielded whose armouring 11 makes it possible to only magnetize the volume useful for electronic cyclotronic resonance in the chamber 1.

Apart from the armouring 11, this magnetic structure includes permanent magnets 7 and solenoids 9 disposed around the chamber 1 and respectively creating one radial magnetic field and one axial magnetic field. These two magnetic fields are superimposed and distributed inside the entire chamber ; they thus form one resultant magnetic field which defines a resonant equimagnetic surface 13 inside the chamber 1.

A magnetic axis 15, which is also the longitudinal axis of the source, traverses the armouring 11 through two openings 17 and 19 disposed inside said armouring 11 so as to respectively allow for the extraction of the ions from the chamber 1, as well as the introduction of electromagnetic waves and gaseous or solid samples.

One first and one second dielectric pipes 23 and 21 connect the opening 19 of the armouring 11 to respective openings 25 and 27 of the transition cavity 20, these openings being situated on the lateral faces of the cavity 20 which has the shape of a cube. The relation of the diameters of these two pipes 21, 23 is such that it is possible to assimilate them with a characteristic coaxial impedance line of about 85 Ω. This coaxial line preferably propagates an Electromagnetic Transversal electromagnetic mode (ETM) in which the electromagnetic field $\vec{E}$ is transversal to the propagation direction of the waves and perpendicular to the surface of the conductors, that is the pipes 21, 23.

In order to ionize a gas, said gas is introduced into the chamber 1 by means of a gas pipe 30 connected to the opening 27 of the transition cavity 20. The gas and the electromagnetic waves introduced into the cavity 20 are transmitted to the chamber 1 by the first and second pipes 21 and 23, the role of the first pipe being to transmit said waves towards said chamber and to inject them there along the longitudinal axis 15.

Inside the chamber 1, the association of the axial magnetic field with the electromagnetic field makes it possible to fully ionize the gas introduced. The electrons produced are then highly accelerated by means of electronic cyclotronic resonance, which results in the formation of a plasma of hot electrons confined inside the volume limited by the equimagnetic surface 13.

The ions thus formed inside the chamber 1 are extracted from the latter by means of an extraction electric field generated by a potential difference applied between an electrode 31 and the chamber 1. The electrode 31 and the chamber are both connected to an electric power feed source 33, the electrode 31 being positioned outside the opening 17 of the chamber 1.

So as to control the intensity of the ion current, it is possible to control the average power of the electromagnetic field by acting on a pulse generator 35 situated upstream of a power feed source 37 connected to the electromagnetic wave generator. Said pulse generator 35 controls said power source 37 by adjusting the effective cycle, namely the ratio between the duration of one pulse and the period of the pulses.

Furthermore, full pressure measuring means 39 are connected to one input of a comparator 41 whose output is connected to a valve 43 of the gas pipe 30. On one second input of the comparator 41, a reference voltage R is applied and compared with the measured value of the ions current so as to provide at the comparator outlet the value to be transmitted to the valve 43. This valve 43 is able to act on the quantity of gas to be introduced into the chamber 1 so as to automatically adjust the ions current.

In addition, an adaptation piston 45 connected to a third lateral opening 29 of the cavity 20 makes it possible to adjust the internal volume of said cavity 20. The adjustment of said piston 45 is used so as to tune all the internal volumes of the cavity 20 to the frequency of the electromagnetic waves so as to obtain a minimum number of reflected waves, that is waves which return to the wave generator 3. When these internal volumes are tuned to the frequency of the electromagnetic waves, the waves injected into the cavity 20 by the generator 3 are virtually fully transmitted by the pipes 21 and 23 to the chamber 1 containing the plasma and are then absorbed by the equimagnetic surface 13.

In this source of ions of the prior art, the second pipe 23 is transparent to the electromagnetic waves at its extremity 23*a*, this extremity being adjacent to the opening 19 of the chamber 1 situated opposite the armouring 11.

Inside the internal volume of this transparent portion 23*a*, there is an axial magnetic field originating from solenoids, one electromagnetic field and one high gas pressure. The electromagnetic field derives from electromagnetic waves transmitted between the first pipe 21 and one non-transparent portion 23*b* of the second pipe 23 and which traverse the transparent portion 23*a* of the second pipe 23. Owing to this, electronic cyclotronic resonance may take place inside the extremity 23*a* of the second pipe 23 inside a volume where there exists high gas pressure. The denser is the plasma produced by electronic cyclotronic resonance inside the extremity 23*a*, the better is transmission of the electromagnetic waves, this dense plasma cord becoming a conductor. Furthermore, this plasma cord has the same outer diameter as the portion 23*b* of the second pipe. The characteristic impedance of the coaxial line is thus not modified, which makes it possible to avoid reflection of the electromagnetic waves.

This extremity transparent to the electromagnetic waves thus constitutes a self-adjusted pre-ionization stage where the excess incident power of the electromagnetic waves is transmitted without reflection as far as the electronic cyclotronic resonance zone constituted by the equimagnetic surface 13.

Therefore, so as to optimize a source of ions as described in the prior art, it is firstly necessary to adjust the volume of the transition cavity 20 by acting on the adaptation piston 45 and secondly adjust the intensity of the current in the solenoids 9. These adjustments, even if carried out by an experienced operator, may turn out to be extremely long: they may last hours, indeed days without nevertheless resulting in obtaining the performance optimum of the source. In fact, these adjustments do not obey any known rule used to optimize the source of ions.

SUMMARY OF THE INVENTION

The object of the present invention is to provide a device to optimize a source of ions with electronic cyclotronic resonance including:

one chamber containing a plasma of ions and electrons formed by electronic cyclotronic resonance;

one magnetic structure comprising one outer armouring, said structure surrounding the chamber and creating inside the latter two fields, namely one radial and one axial magnetic field ensuring a confinement of the plasma inside the chamber;

a transition cavity connected to an electromagnetic wave generator; and one first and one second dielectric pipe connecting the chamber and the cavity, the second pipe comprising one transparent portion opposite the armouring in which a resonance is produced at a specific point C, wherein it comprises means for moving the resonance point so as to optimally adjust the position of said resonance point in the second dielectric pipe.

Advantageously, the means for moving the resonance point comprise one tubular piece placed around the second pipe at the level of the transparent portion and able to be translated parallel to the pipes.

According to one preferred embodiment, the tubular piece comprises on its external peripheral portion a threading embodied in such a way as to form, along with the armouring, a screw/nut system.

BRIEF DESCRIPTION OF THE DRAWINGS

Other characteristics and advantages of the invention shall appear more readily from a reading of the following description, given by way of illustration but being non-restrictive, with reference to the drawings on which.

DETAILED DESCRIPTION OF THE PREFERRED EMBODIMENTS

Figure 1:
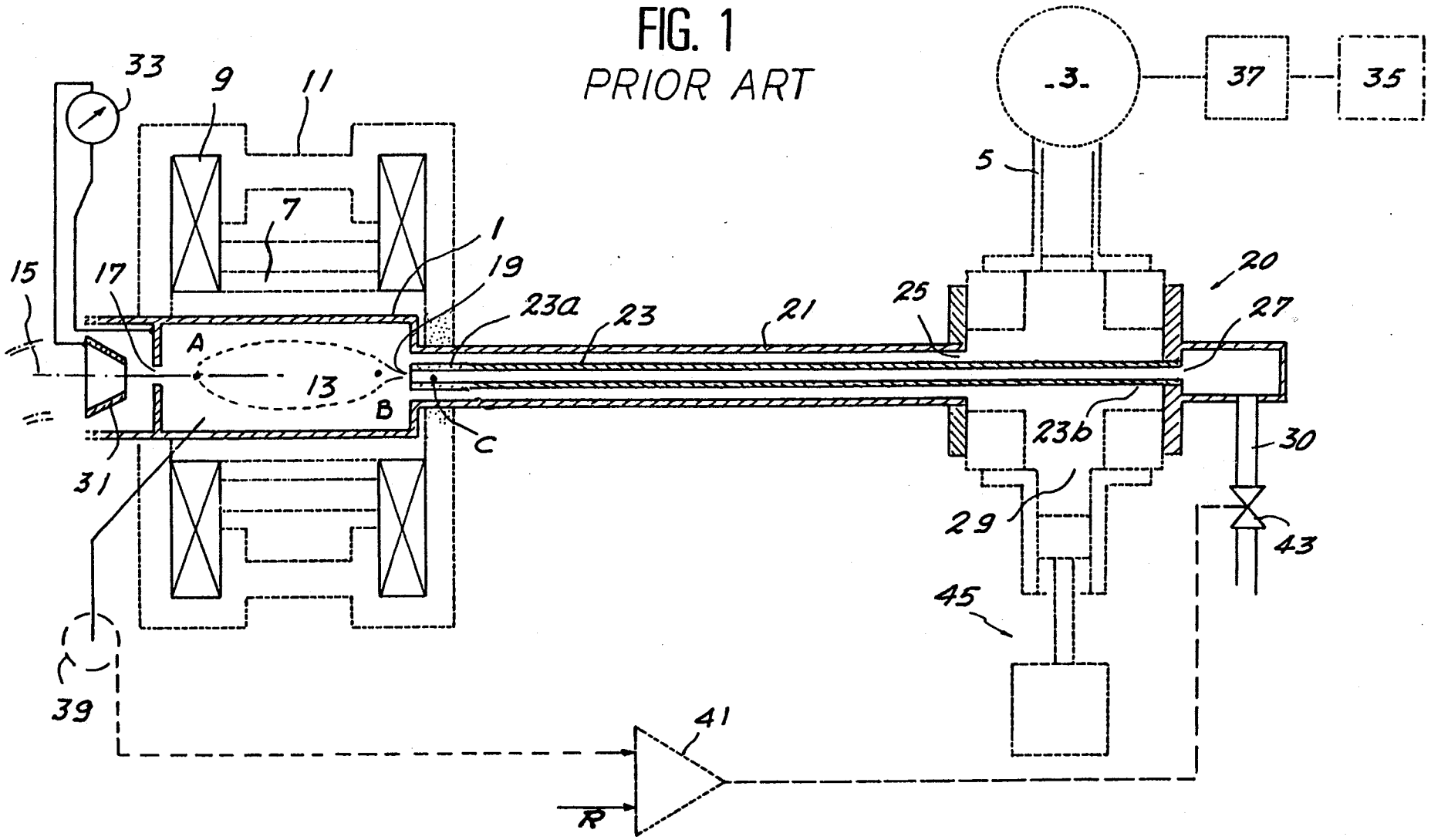
FIG. 1 PRIOR ART
FIG. 1, already described, diagrammatically represents an ECR. source of ions according to the prior art.

On one coaxial line as describe previously and on which the ETM electromagnetic mode propagates, there generally are waves which are stationary due to reflection of the propagated wave. For the electric wave $\vec{E}$ of the electromagnetic wave, the stationary waves are tension waves. There is then a succession of tension node and antinode points between the two pipes 21 and 23, the distance between two nodes or two antinodes being equal to the wave half-length $\lambda$ of the electromagnetic waves injected into the source of ions.

In this source of ions, there are three notable points A, B and C of the magnetic axis 15. At these three points A, B and C, the electronic cyclotronic resonance (ECR) condition is verified, namely:

$$\omega HF = \omega ce,$$

in other words, the pulse of the electromagnetic waves HF has the same value as the giromagnetic pulse of the electrons, namely the "electronic cyclotron" pulse which is expressed as follows:

$$\omega ce = \frac{e}{m} Br, \qquad \text{(E2)}$$

in which e is the charge of the electron, m its mass and Br the value of the resonant induction.

Thus, at these notable points A, B and C, the following expression deduced from (E1) and (E2) is verified:

$$|\vec{Br}| = \frac{m}{e}\,\omega HF.$$

For a source of ions as described previously, the points A and B represent the extremities of the equimagnetic surface 13, also known as the closed o resonant surface, situated inside the confinement plasma. The point C is situated in the second dielectric pipe 23 inside the preionization plasma, that is at the level of the magnetic armouring 11, said armouring provoking the sudden fall of the magnetic induction. The portion of the pipes 21 and 23 situated at the level of the armouring 11 is a zone with a high magnetic gradient, that is a zone where the magnetic induction varies significantly.

Figure 2:
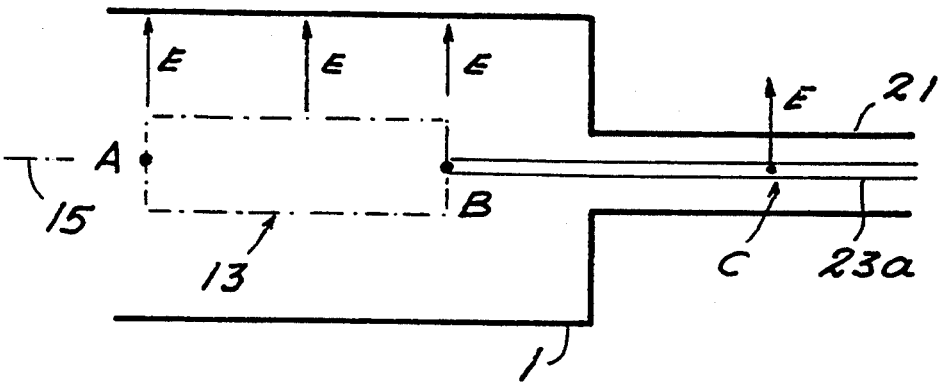
FIG. 2 shows an electric diagram created inside the source of ion when said source is optimized.

FIG. 2 shows the electric diagram created inside the ECR source of ions when said source is optimized. The electric fields $\vec{E}$ are then optimum at the resonance points A, B and C.

In fact, the ECR resonance is optimized at the point C when the electric field $\vec{E}$ reaches its maximum value where it is perpendicular to the resonant induction field and is on a small radius cylinder, that is on the second pipe 23 with a small radius.

In addition, when this optimized ECR resonance exists, the preionization plasma created in the dielectric pipes 21 and 23 is so dense that it virtually becomes a conductor and spreading as far as the equimagnetic surface 13, thus reaching the point B. This equimagnetic surface 13 also contains a dense plasma able to absorb and reflect the electromagnetic waves, thus rendering said surface 13 semiconductive from the point B to the point A.

Thus, from an electromagnetic point of view, the ECR source of ions behaves like a coaxial line up to the point A of the magnetic axis 15. This open line is then the seat of stationary waves between the point A and the piston 45.

From a more practical point of view, the diameters d and D of the respective conductors 23 and 21 are fixed optimally by observing the following law:

$$\frac{D-d}{2} = \frac{\lambda}{3}$$

Similarly, the diameters D' and d' respectively of the chamber 1 and of the equimagnetic surface 13 are selected optimally when this law is verified, namely:

$$\frac{D'-d'}{2} = \frac{\lambda}{3}$$

So as to optimize this source of ions, in other words for the electric fields $\vec{E}$ to be also optimum at A and B, an important condition concerning the distance between these points A, B and C needs to be verified. The distances between two points A and B, B and C or C and A are equal to a whole number (n or m) times the wave half-length λ of the electromagnetic waves introduced into the source. Thus:

$$AB = n\frac{\lambda}{2}, \text{ and}$$

-continued $$AC = m\frac{\lambda}{2},$$

expressions for which the wavelength λ is a known value from the moment when the frequency f of the electromagnetic waves injected by the generator 3 is known, the wavelength being equivalent to the propagation speed c on the frequency f of the waves introduced.

Figure 3:
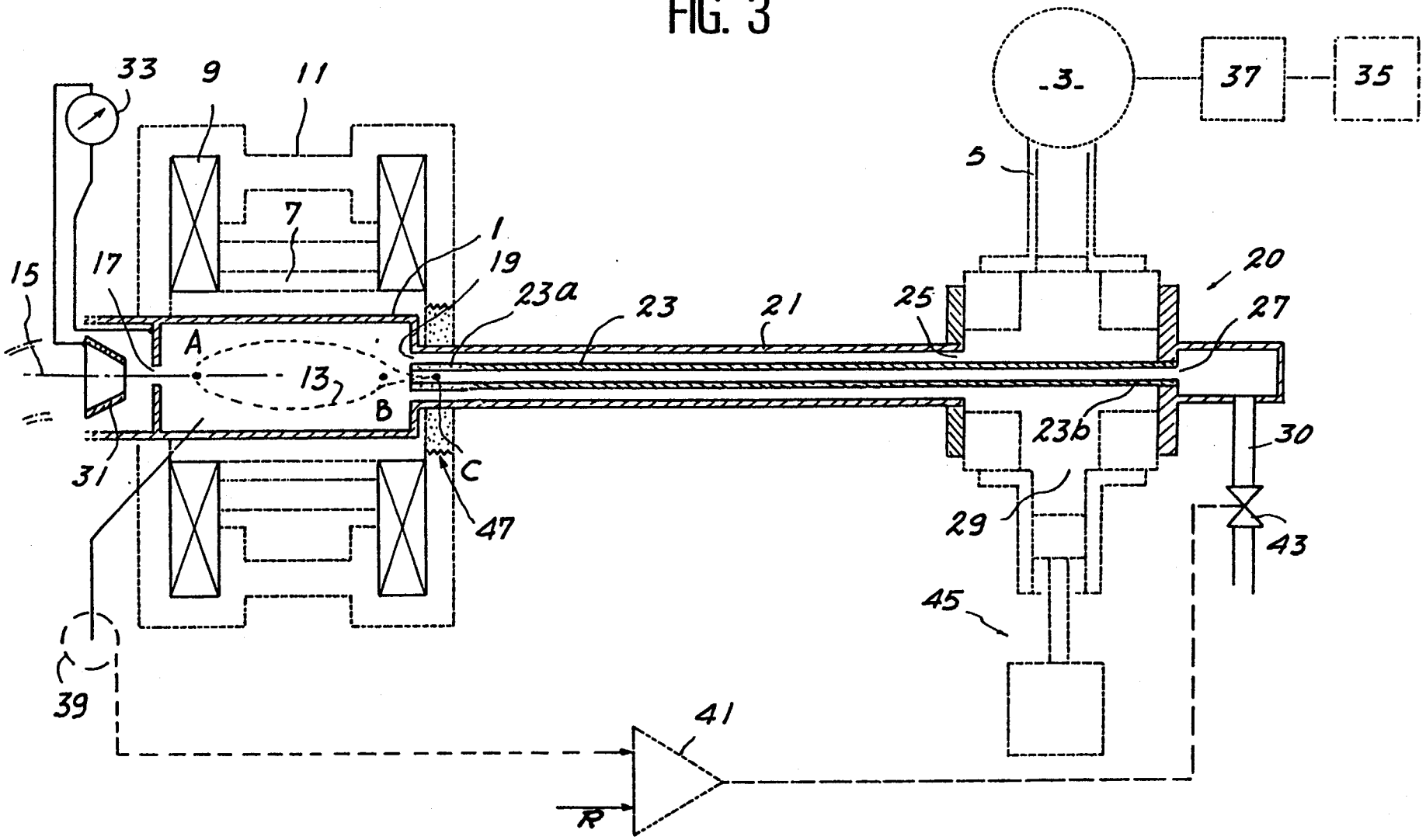
FIG. 3 diagrammatically shows an ECR source of ions optimized according to the invention.

FIG. 3 is a diagrammatic representation of the source of ions comprising the device of the invention making it possible to optimize the position of the points A, B and C.

The ECR source shown on FIG. 3 is the same as the ECR source of the prior art and to which added is the optimization device of the invention, said ECR source having been described at the start of the description. All the elements referred to in the description of FIG. 1 retain the same references on FIG. 3 to be described as follows.

Figure 4:
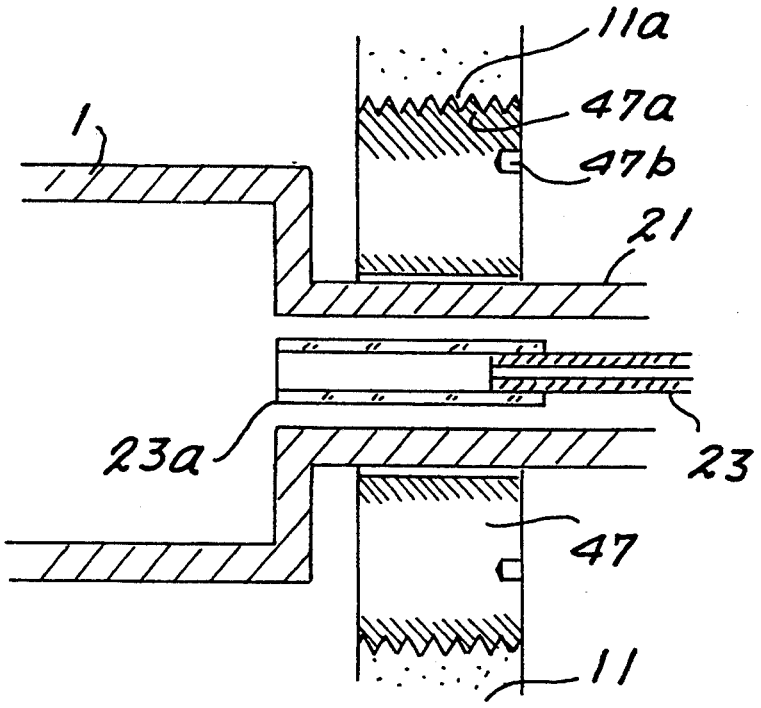
FIG. 4 diagrammatically shows the invented device so as to optimize the ECR source of FIG. 1.

The device to optimize an ECR source is shown on FIG. 4. It consists of one tubular piece 47 known as a magnetic screw, this screw 47 being placed around the first pipe 21 with an adequate play of about 0.5 mm so as to avoid any friction with said pipe 21 when the latter is translation-moved with respect to the armouring 11. This tubular piece 47 with the same thickness as the armouring 11 includes on its periphery a threading **47*a* able to be screwed onto the tapped portion (11*a*) of the armouring 11. The screwing/unscrewing of the magnetic screw 47 on the armouring 11 ensures the movement of said magnetic screw 47**.

This magnetic screw 47 is made of iron. Owing to this, there is a high magnetic gradient at the level of the armouring which makes it possible to act on the position of the resonance point C. In fact, the point C almost follows the movement of said tubular piece 47 with respect to the armouring 11.

The movement of the tubular piece 47 is effected by means of a special tool provided with two dog points to be engaged in two of the four holes **47*b* in the tubular piece 47. These four holes 47*b* are evenly distributed over the outer surface of the magnetic screw 47 and are each on an axis parallel to the magnetic axis 15. The special tool provided with its two dog points is engaged in two diametrically opposing holes, thus making it possible to rotate the screw 47**.

The translation of the magnetic screw 47 is effected in the absence of any magnetic field, that is when the ECR source is stopped. In the presence of the magnetic field created by the solenoids 9, an interaction is established between the magnetic screw 47 and the armouring 11. In fact, a significant magnetic force then opposes the translation of the screw 47, the threading **47*a* of the screw 47 then pressing strongly on the internal screw thread 11*a* of the armouring 11**, thus ensuring magnetic continuity inside the armouring of the ECR source.

However, so as to fully optimize the source of ions, this adjustment of the positioning of the point C by acting on the magnetic screw 47 needs to be completed by two adjustments depending on said adjustment of the screw 47. These adjustments allow for optimization of the source by successive approaches.

The optimum of the electric field $\vec{E}$ at the point C is obtained with high gas pressure so as to optimize the source on the low ionic charge states. This optimum is determined by firstly adjusting the screw 47 and secondly the position of the piston 45. There is then one first position of the point C. According to a previous knowledge of the axial magnetic profile of the ECR source, the points A and B are positioned by adjusting the intensity of the current in the two solenoids 9, this intensity being controlled by external feedings which, for example, supply a current varying from 0 to 1000 amperes.

All these three adjustments are renewed several times for increasingly weaker gas pressures until obtaining optimization of the source on the high ionic charge states.

According to one embodiment of an ECR source conforming to the invention, the diameter of the chamber 1 is about 6 centimeters and the wavelength λ of the waves introduced is three centimeters, namely a frequency of 10 GHz. For this source, all the adjustments need to be carried out for a power of electromagnetic waves of less than 100 Watts. An experienced operator is able to optimize this source in five or six operations, this is within several minutes.

What is claimed is:

1. A source of ions with electronic cyclotronic resonance comprising, in combination,:

a chamber containing a plasma of ions and electrons formed by electronic cyclotronic resonance;

a magnetic structure comprising an outer armouring, said structure surrounding the chamber and creating inside the latter two radial and axial magnetic fields ensuring a confinement of the plasma inside the chamber;

a transition cavity connected to an electromagnetic wave generator; and a first and a second dielectric pipe connecting the chamber and the cavity, the second pipe comprising a transparent portion opposite the armouring in which a resonance is produced at a specific point, wherein the source of ions comprises means for moving the resonance point so as to optimally adjust the position of said resonance point in the second dielectric pipe, wherein the means for moving the resonance point comprises a tubular piece comprising, on its external peripheral portion, a threading so as to form, along with the armouring, a screw/nut system, said tubular piece being placed around the second pipe at the level of the transparent portion, said piece being translatably parallel to the pipes.

2. A source of ions with electronic cyclotronic resonance, and comprising:

a. a chamber containing a plasma of ions and electrons formed by electronic cyclotronic resonance;

b. a magnetic structure comprising one outer armouring, said structure surrounding the chamber and creating inside the latter two radial and axial magnetic fields ensuring a confinement of the plasma inside the chamber;

c. a transition cavity connected to an electromagnetic wave generator; and d. first and second dielectric pipes connecting said chamber and said cavity, said second pipe comprising a transparent portion opposite said armouring in which an electronic cyclotronic resonance is produced at a specific point; and e. means for moving said resonance point so as to optimally adjust position of said resonance point in said second pipe, said moving means comprising a ferromagnetic tubular piece placed around said second pipe at the level of said transparent portion, said piece being translatable in a direction parallel to said pipes.

3. A device according to claim 2, wherein the tubular piece comprises on its external peripheral portion a threading so as to form, along with the armouring, a screw/nut system.

* * * * *